US005820700A

United States Patent [19]

DeLuca et al.

[11] Patent Number: 5,820,700

[45] Date of Patent: Oct. 13, 1998

[54] NICKEL BASE SUPERALLOY COLUMNAR GRAIN AND EQUIAXED MATERIALS WITH IMPROVED PERFORMANCE IN HYDROGEN AND AIR

[75] Inventors: Daniel P. DeLuca, Tequesta; Charles M. Biondo, Palm Beach Gardens, both of Fla.

[73] Assignee: United Technologies Corporation, Hartford, Conn.

[21] Appl. No.: 539,091

[22] Filed: Oct. 4, 1995

Related U.S. Application Data

[63] Continuation-in-part of Ser. No. 284,727, Aug. 2, 1994, abandoned, which is a continuation of Ser. No. 75,154, Jun. 10, 1993, abandoned.

[51] Int. Cl.[6] ..... C22C 19/05

[52] U.S. Cl. ..... 148/410; 148/404; 60/909

[58] Field of Search ..... 148/410, 428, 148/404; 415/200; 416/241 R, 223 R; 60/909

[56] References Cited

U.S. PATENT DOCUMENTS

| | | | |
|---|---|---|---|
| 3,403,059 | 9/1968 | Barker et al. . | |
| 3,415,641 | 12/1968 | Ross . | |
| 3,536,542 | 10/1970 | Murphy et al. . | |
| 3,576,681 | 4/1971 | Barker et al. . | |
| 3,642,543 | 2/1972 | Owczarski et al. . | |
| 3,667,938 | 6/1972 | Boesch . | |
| 3,677,746 | 7/1972 | Lund et al. . | |
| 3,711,936 | 1/1973 | Athey | 29/475 |
| 3,741,824 | 6/1973 | Duvall et al. . | |
| 3,748,192 | 7/1973 | Boesch . | |
| 3,915,761 | 10/1975 | Tschinkel et al. | 148/428 |
| 3,973,952 | 8/1976 | Bieber et al. . | |
| 4,083,734 | 4/1978 | Boesch . | |
| 4,099,992 | 7/1978 | Pugliese et al. | 148/675 |
| 4,245,698 | 1/1981 | Berkowitz et al. | 166/244 |
| 4,253,884 | 3/1981 | Maurer et al. . | |

(List continued on next page.)

FOREIGN PATENT DOCUMENTS

| | | | |
|---|---|---|---|
| 3731598 | 6/1988 | Germany | 148/410 |

OTHER PUBLICATIONS

Dissertation Abstracts International vol. 51, No. 4; Oct. 1990 p. 2030B #DA9023438.

Metallurgical Transactions A (Apr. 1992) 23A (4) 1313–1322 W.S. Walston; I.M. Bernstein and A.W. Thompson.

Journal of Materals Science; 29 (1994) 2445–2458.

Metallurgical Trans A 3 (Aug. 1972)2157–2162.

Metal Alloys Index 92(2):31–885, Feb. 1972.

Metal Alloys Index 94 (3):31–1378, Mar. 1994.

DeLuca et al; Superalloys 718, 625. 706 Var Deriv., Proc. Int. Symp., 3rd (1994), 817–26.

Scripta Metallurgica et Materialia, vol. 25, pp. 2589–2594 by J. Gayda, R.L. Dreshfield, and T.P. Gabb, Nov. 1991.

Chemical Abstract, 118:152449, Apr. 1993.

*Primary Examiner*—David A. Simmons
*Assistant Examiner*—Margery S. Phipps
*Attorney, Agent, or Firm*—Brooks, Haidt, Haffner & Delahunty

[57] ABSTRACT

A nickel base superalloy, having either columnar or equiaxed grain structure, which has significantly improved resistance to hydrogen embrittlement, and to fatigue in air is disclosed. The superalloy consists essentially of, in weight percent, about 0.006–0.17 carbon, about 6.0–22.0 chromium, up to about 17.0 cobalt, up to about 9.0 molybdenum, up to about 12.5 tungsten, up to about 5.0 titanium, up to about 6.7 aluminum, up to about 4.5 tantalum, up to about 2.5 hafnium, up to about 18.5 iron, up to about 3.25 rhenium, up to about 1.25 columbium, remainder nickel. The microstructure of the superalloy consists essentially of a plurality of fine, discrete carbide particles, γ' precipitates in a γ matrix, and is essentially free of script carbides, γ/γ' eutectic islands and porosity.

6 Claims, 3 Drawing Sheets

500X

U.S. PATENT DOCUMENTS

| | | | |
|---|---|---|---|
| 4,305,761 | 12/1981 | Bruch et al. . | |
| 4,379,120 | 4/1983 | Whitney et al. | 420/448 |
| 4,421,571 | 12/1983 | Kudo et al. | 148/675 |
| 4,461,659 | 7/1984 | Harris | 148/428 |
| 4,512,817 | 4/1985 | Duhl et al. . | |
| 4,518,442 | 5/1985 | Chin . | |
| 4,529,452 | 7/1985 | Walker | 148/675 |
| 4,676,846 | 6/1987 | Harf . | |
| 4,717,432 | 1/1988 | Ault . | |
| 4,782,992 | 11/1988 | Doble | 228/190 |
| 4,878,952 | 11/1989 | Pilloeffer . | |
| 4,907,736 | 3/1990 | Doble | 228/190 |
| 4,957,567 | 9/1990 | Krueger et al. | 148/677 |
| 4,964,453 | 10/1990 | Schmidt et al. | 164/122.1 |
| 5,047,091 | 9/1991 | Khan et al. . | |
| 5,100,484 | 3/1992 | Wukusick et al. . | |
| 5,143,563 | 9/1992 | Krueger et al. | 148/410 |
| 5,328,659 | 7/1994 | Tilman et al. | 420/448 |
| 5,374,319 | 12/1994 | Stueber et al. | 148/404 |
| 5,413,752 | 5/1995 | Kissinger et al. | 419/28 |

500 X

500 X

500X

500X

NICKEL BASE SUPERALLOY COLUMNAR GRAIN AND EQUIAXED MATERIALS WITH IMPROVED PERFORMANCE IN HYDROGEN AND AIR

This is a continuation-in-part of application Ser. No. 08/284,727, filed Aug. 2, 1994, now abandoned, which is a continuation of application Ser. No. 08/075,154, filed Jun. 10, 1993, now abandoned.

TECHNICAL FIELD

This invention related to nickel base superalloys possessing improved resistance to hydrogen embrittlement, and also improved fatigue resistance in air.

BACKGROUND OF THE INVENTION

The present invention deals with improvements to the hydrogen embrittlement resistance of high strength nickel base columnar grain and equiaxed materials. The same principles which provide the improvements to hydrogen embrittlement resistance would also be expected to provide significant benefits to the fatigue behavior of the materials when used in an air atmosphere.

High strength nickel base superalloys are defined in the context of this invention as nickel base alloys containing more than about fifty volume percent of the strengthening γ' phase in a γ matrix and having yield strength in excess of 100 ksi at 1000° F. Such alloys find their widest, and heretofore almost exclusive, application in the field of gas turbine engines. To the best of our knowledge, hydrogen embrittlement has only infrequently been a limiting factor in the performance of high strength nickel base superalloys.

In gas turbine engines, hydrocarbon fuels are burned, and free hydrogen may be present at some points during the combustion process, but the relatively low concentration of available hydrogen, and the operating conditions of such engines, have not been found to cause any significant hydrogen embrittlement of the nickel base superalloys.

Recently, however, in the development of the space shuttle main engines, hydrogen embrittlement has been recognized to be a significant problem. The space shuttle main engines are rocket engines which mix and react liquid hydrogen and liquid oxygen to form the propellant. These reactants are pumped into the main combustion chamber by turbo pumps which are powered by the combustion products of the reaction of hydrogen and oxygen. The hot side of the turbo pumps, which is exposed to the combustion products of the hydrogen/oxygen reaction, includes a multiplicity of small turbine blades which are investment cast from directionally solidified Mar-M246 +Hf alloy, an alloy which meets the previous definition of a high strength nickel base superalloy in that is contains more than fifty volume percent of the γ' phase and has a yield strength of more than 100 ksi at 1000° F. The nominal composition of Mar-M246 +Hf is 9 Cr, 10 Co, 2.5 Mo, 10 W, 1.5 Ta, 5.5 Al, 1.5 Ti, 1.5 Hf, balance Ni, where each standard chemical symbol represents the weight percentage of the corresponding element. Hydrogen embrittlement of these turbine blades is a problem of great concern and is one of the factors which requires the space shuttle main engine pumps to be rebuilt with substantially greater frequency than originally anticipated.

Hydrogen embrittlement has been most commonly encountered in other fields of metallurgy, involving other metals and other environments. Hydrogen embrittlement occurs at times during electroplating, where hydrogen gas is generated directly on the surface of the part being plated and is absorbed into the part, greatly reducing the ductility of the part. Hydrogen embrittlement is also a factor in some forms of hot corrosion, especially hot corrosion which is observed in oil well drilling wherein deep drilled oil well casings are prone to hydrogen embrittlement as a result of the hydrogen sulfide present in some of the crude petroleum and natural gas which pass through the casings. U.S. Pat. Nos. 4,099,992, 4,421,571 and 4,245,698 are typical of the attempts to solve oil well hydrogen embrittlement problems.

Hydrogen embrittlement is encountered in these and other circumstances, and, while the exact mechanism involved is still open to conjecture, the existence of the problem is well documented. Initiation of hydrogen embrittlement cracking in nickel base superalloys has been found to occur at discontinuities in the structure, such as pores, hard particles and interfaces between precipitated phases and the matrix, such as script type carbides and γ/γ' eutectic islands. Fatigue crack initiation has also been observed at similar sites in equiaxed superalloy materials, such as PWA 1489, which has a nominal composition of 8.4 Cr, 10 Co, 0.65 Mo, 5.5 Al, 3.1 Ta, 10 W, 1.4 Hf, 1.1 Ti, 0.015 B, 0.05 Zr, balance Ni, with all quantities expressed in weight percent. Strong evidence has been observed for the occurrence of interphase cleavage at the interfaces between the γ matrix and γ' particles, and within γ/γ' eutectic islands. These features have been identified as fatigue crack initiation sites in this class of alloys in hydrogen.

SUMMARY OF THE INVENTION

According to the present invention, a class of nickel base superalloy compositions is described which can be processed by heat treatment and hot isostatic pressing (HIP) to provide a high strength nickel base columnar grain or equiaxed superalloy material which is highly resistant to hydrogen embrittlement. The principles taught in this invention are also expected to provide marked increases in the fatigue resistance of these alloys when used in more common applications, such as gas turbine engines.

The mechanism of the present invention is twofold: (1) the elimination of fatigue initiation sites such as script carbides and, most significantly, γ/γ' eutectic islands, both of which act as discontinuities and stress risers at which fatigue cracks can initiate in either air or hydrogen, and (2) the elimination of porosity by HIP, which significantly increases elevated temperature fatigue resistance.

Since the existence of such hard particles as carbides, nitrides and borides can be the source of fatigue crack initiation, the heat treatment process of the present invention is designed to solution essentially all of these hard particles, while leaving only enough of these particles in the grain boundaries to control grain growth in equiaxed alloys. During cooling from the solution cycle, the solutioned carbides are reprecipitated as fine discrete particles evenly distributed throughout the microstructure.

In the presence of hydrogen, eutectic islands provide crack initiation sites by cleaving at the interfaces of the γ and γ' lamellae. Eliminating eutectic islands thus significantly retards cracking in the presence of hydrogen. Script carbides also provide fatigue crack initiation sites and, by minimizing their size and frequency of occurrence, fatigue life is also improved.

The invention process is applicable to nickel base superalloys in which the γ/γ' eutectic islands and script type carbides can be essentially completely solutioned without incurring incipient melting. In accordance with this invention, the alloy is a gamma prime strengthened nickel base alloy consisting essentially of the composition set forth in Table 1 (approximate weight percent ranges).

TABLE 1

| | (wt. %) | range | (wt. %) |
|---|---|---|---|
| Carbon | 0.006 | | 0.17 |
| Chromium | 6.0 | | 22.0 |
| Cobalt | — | | 17.0 |
| Molybdenum | — | | 9.0 |
| Tungsten | — | | 12.5 |
| Titanium | — | | 5.0 |
| Aluminum | — | | 6.7 |
| Tantalum | — | | 4.5 |
| Hafhium | — | | 2.5 |
| Iron | — | | 18.5 |
| Rhenium | — | | 3.25 |
| Columbium | — | | 1.25 |
| Nickel | remainder | | |

In a preferred embodiment, the alloy consists essentially of the composition set forth in Table 2 (approximate weight percent ranges).

TABLE 2

| | (wt. %) | range | (wt. %) |
|---|---|---|---|
| Carbon | 0.13 | | 0.17 |
| Chromium | 8.00 | | 8.80 |
| Cobalt | 9.00 | | 11.0 |
| Molybdenum | 0.50 | | 0.80 |
| Tungsten | 9.50 | | 10.50 |
| Titanium | 0.90 | | 1.20 |
| Aluminum | 5.30 | | 5.70 |
| Tantalum | 2.80 | | 3.30 |
| Hafhium | 1.20 | | 1.6 |
| Iron | — | | .25 |
| Columbium | — | | 0.10 |
| Nickel | remainder | | |

One of ordinary skill in the art will recognize that various trace elements, including but not limited to, manganese, silicon, phosphorus, sulfur, boron, zirconium, bismuth, lead, selenium, tellurium, thallium, and copper may be present in minor amounts.

The alloys are cast either in equiaxed or columnar grain form, and heat treated using a stepped ramp cycle (similar to those currently used for single crystal alloys) to permit solutioning at a temperature approximately 50° F. above the γ' solvus temperature so that the γ/γ' eutectic islands and the script type carbides are dissolved. The alloys are then HIPped below the solvus temperature for a period of about four hours to eliminate all porosity, cavities and voids. The material is then given conventional lower temperature heat treatments to produce a γ' morphology which tailors the mechanical properties of the material to the requirements of the particular application. The resultant product is a high strength nickel base superalloy material which has significantly improved resistance to fatigue in hydrogen as well as in air.

The foregoing and other features and advantages of the present invention will become more apparent from the following description and accompanying figures.

BEST MODE FOR CARRYING OUT THE INVENTION

The fatigue cracking of polycrystalline nickel base superalloys in a hydrogen environment is due to the initiation of fatigue cracks at the interfaces between the γ and the γ' lamellae in the γ/γ' eutectic islands and crack initiation at script-type carbides.

Figure 1:
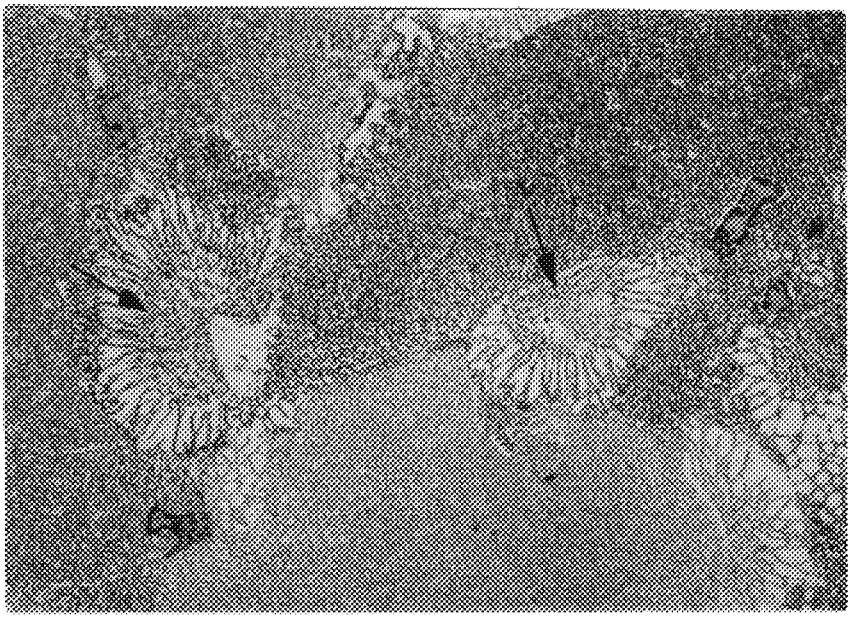
FIG. 1 is a photomicrograph of a prior art PWA 1489 microstructure showing the presence of γ/γ' eutectic islands, as indicated by the arrows.
Figure 2:
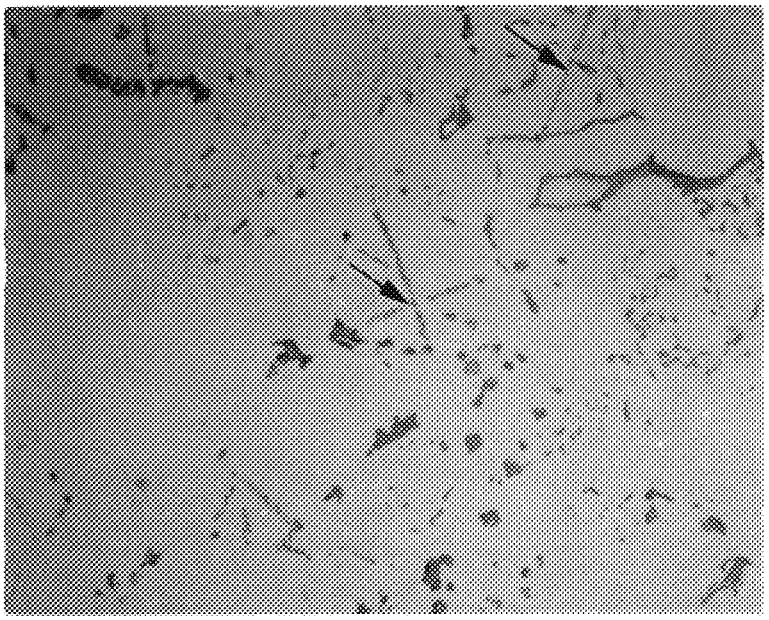
FIG. 2 is a photomicrograph of a prior art PWA 1489 microstructure showing the presence of typical script type carbides as indicated by the arrows.

PWA 1489 is an equiaxed nickel base superalloy used primarily for components requiring high thermal shock resistance and high strength at cryogenic and elevated temperatures. In prior art applications, it has been vacuum melted and cast, HIPped and solution heat treated. FIG. 1 shows γ/γ' eutectic islands and FIG. 2 shows script-type carbides present in PWA 1489 processed using prior art techniques.

While the presence of script-type carbides and γ/γ' eutectic islands in alloys such as PWA 1489 was acceptable for the high temperature gas turbine applications, cracking of engine test components in hydrogen environments produces inherent design limitations which must be accounted for. The elimination of script carbides and eutectic islands by thermal processing provides significant property improvements and greater design margins for components produced from these alloys for use in the space shuttle main engine program.

The elimination of these microstructural features requires solutioning the alloy at temperatures significantly above the γ' solvus temperature and can result in incipient melting due to the microstructural chemical inhomogeneities incurred during solidification.

Thus a ramp solution cycle is generally employed to permit heating as much as 50° F. (28° C.) above the γ' solvus temperature. This permits sufficient solutioning to virtually eliminate all script type carbides and eutectic islands. The post-solution cool down cycle was then controlled to allow reprecipitation of fine, discrete carbide particles throughout the microstructure.

Additionally it was determined that the solutioning at the increased temperature could produce various forms of porosity in the microstructure, which could also act as crack initiation sites. Thus it was determined that utilization of a HIP cycle following solution heat treat minimized post heat treat porosity sites. This is in contrast to the procedures associated with single crystal materials, where it was determined that HIP prior to solutioning was preferable (see U.S. patent application Ser. No. 07/968,757 filed on Oct. 30, 1992, which has common inventors with this application, and is of common assignee herewith).

After the appropriate solutioning treatment and the HIP cycle have been applied, conventional precipitation and age treatments are applied to obtain the properties necessary for the desired application of the material.

The process of the present invention may be better understood through reference to the following illustrative example.

EXAMPLE I

PWA 1489 samples were solutioned according to the "super solution" heat treat schedule listed in Table I.

Table I

Heat from room temperature to 2000° F. at 10° F./minute

Ramp from 2000° F. to 2240° F. at 0.2° F./minute

Ramp from 2240° F. to 2275° F. at 0.2° F./minute

Ramp from 2275° F. to 2285° F. at 0.1° F./minute

Hold at 2285° F. for 4 hours

Cool to 1000° F. at 115° F./minute

Air cool to room temperature

The samples were then HIPped at 2165° F.±25° F. at 25 ksi for four hours, precipitation heat treated at 1975° F.±25° F. for four hours and air cooled to room temperature, and aged at 1600° F.±25° F. for 20 hours and air cooled to room temperature.

It is noted that the temperatures for the "super solution" heat treatment are selected relative to the γ' solvus temperature for the particular alloy, and are based on a gradient heat treat study for the particular heat of material. The solution cycle may include several separate ramps at decreasing rates of temperature rise (with or without intermediate periods of constant temperature rise), or a smoothly increasing curve with a gradually decreasing rate of temperature until the maximum solution temperature is achieved. In this example, the first ramp started approximately 230° F. below the γ' solvus temperature (2230°±25° F.), the second ramp started about 10° F. above the γ' solvus temperature, the third ramp started about 45° F. above the γ' solvus temperature, and the hold temperature after the third ramp was about 55° F. above the γ' solvus temperature.

Figure 3:
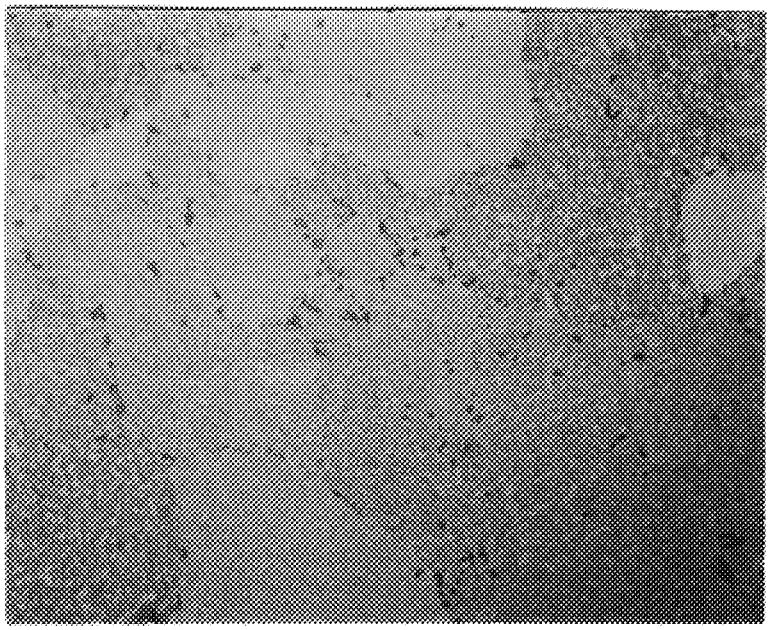
FIG. 3 is a photomicrograph of a PWA 1489 microstructure processed according to the present invention showing the absence of γ/γ' eutectic islands.
Figure 4:
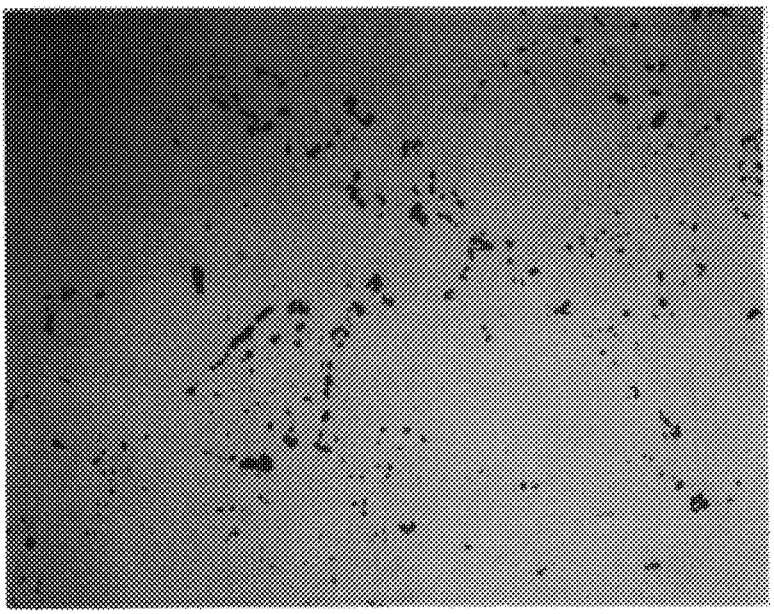
FIG. 4 is a photomicrograph of a PWA 1489 microstructure processed according to the present invention showing the absence of script type carbides.

The microstructure of the invention-processed material is shown in FIG. 3, where the γ/γ' eutectic islands were completely solutioned, and in FIG. 4, which shows that the script-type carbides have also been completely solutioned.

Figure 5:
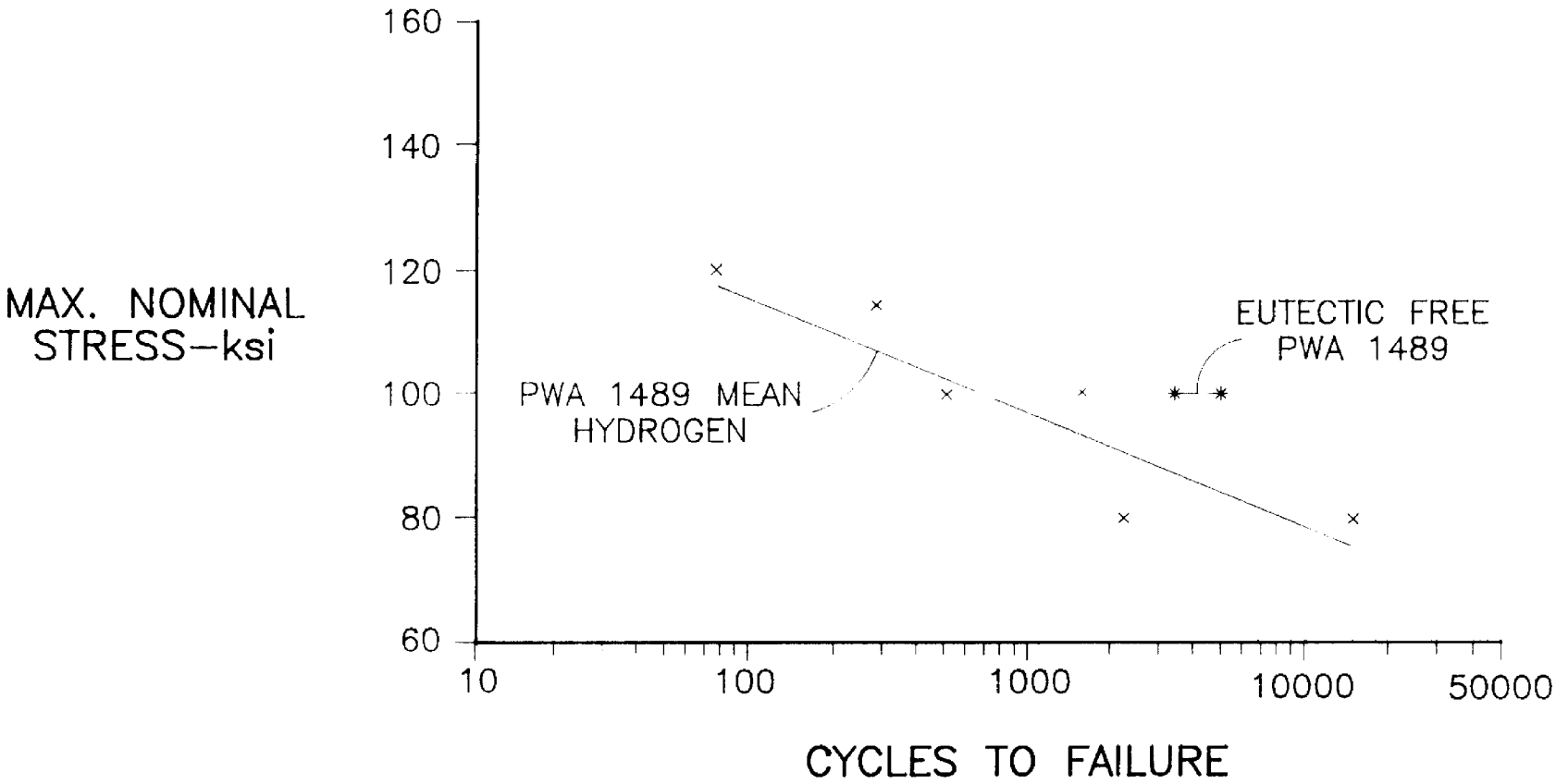
FIG. 5 is a graph showing the fatigue life in hydrogen of prior art PWA 1489 and PWA 1489 processed according to the invention.

Notched low cycle fatigue (LCF) samples were tested in hydrogen at room temperature with R=0.05. The test results are shown in FIG. 5, where the eutectic free samples exhibited significantly longer fatigue life than similar samples of the same material which received prior art processing (HIP followed by the standard solution heat treat at 2165° F. (1185° C.).

Although this invention has been shown and described with respect to detailed embodiments thereof, it will be understood by those skilled in the art that various changes, omissions and additions in form and detail thereof may be made without departing from the spirit and scope of the claimed invention.

We claim:

1. A hydrogen embrittlement resistant γ' precipitation strengthened equiaxed or directionally solidified, columnar grain nickel base alloy having a microstructure consisting essentially of a plurality of fine, discrete carbide particles, and γ' precipitates in a γ matrix and being essentially free of script carbides, γ/γ' eutectic islands and porosity, said nickel base alloy having a γ' solvus temperature and consisting essentially of, in weight percent range:

| | | |
|---|---|---|
| Carbon | 0.13 | 0.17 |
| Chromium | 8.00 | 8.80 |
| Cobalt | 9.00 | 11.0 |

-continued

| | | |
|---|---|---|
| Molybdenum | 0.50 | 0.80 |
| Tungsten | 9.50 | 10.50 |
| Titanium | 0.90 | 1.20 |
| Aluminum | 5.30 | 5.70 |
| Tantalum | 2.80 | 3.30 |
| Hafnium | 1.20 | 1.6 |
| Iron | — | .25 |
| Columbium | — | 0.10 |
| Nickel | | remainder, |

wherein said alloy is processed to be essentially free of script carbides, γ/γ' eutectic islands and porosity by heat treating the alloy to permit solutioning of the script carbides and eutectic islands at a temperature approximately 50° F. above the γ' solvus temperature of the alloy, and hot isostatic pressing for about four hours to eliminate porosity, wherein said alloy has improved resistance to fatigue.

2. A hydrogen embrittlement resistant γ' precipitation strengthened equiaxed or directionally solidified, columnar grain nickel base alloy having a microstructure consisting essentially of a plurality of fine, discrete carbide particles and at least 50 volume % of γ' precipitates in a γ matrix and being essentially free of script carbides, γ/γ' eutectic islands and porosity, said nickel base alloy having a γ' solvus temperature and consisting essentially of, in weight percent range:

| | | |
|---|---|---|
| Carbon | 0.13 | 0.17 |
| Chromium | 8.00 | 8.80 |
| Cobalt | 9.00 | 11.0 |
| Molybdenum | 0.50 | 0.80 |
| Tungsten | 9.50 | 10.50 |
| Titanium | 0.90 | 1.20 |
| Aluminum | 5.30 | 5.70 |
| Tantalum | 2.80 | 3.30 |
| Hafnium | 1.20 | 1.60 |
| Iron | — | 0.25 |
| Columbium | — | 0.10 |
| Nickel | | remainder, |

wherein said alloy is processed to be essentially free of script carbides, γ/γ' eutectic islands and porosity by heat treating the alloy at a temperature sufficiently above its γ' solvus temperature to dissolve the γ/γ' eutectic islands and script carbides without causing incipient melting, and cooling at a rate equal to or greater than 100° F. per minute to a temperature less than 1000° F.; hot isostatic pressing the alloy to elinnate porosity; and precipitation heat treating the alloy at 1975° F.±25° F. for four hours, air cooling to room temperature, aging at 1600° F.±25° F. for twenty hours and air cooling to room temperature, wherein said alloy has improved resistance to fatigue.

3. A hydrogen embrittlement resistant γ' precipitation strengthened equiaxed or directionally solidified, columnar grain nickel base alloy having a microstructure consisting essentially of a pluralith of fine, discrete carbide particles, and γ' precipitates in a γ matrix and being essentially free of script carbides, γ/γ' eutectic islands and porosity, said nickel base alloy having a γ' solvus temperature and consisting essentially of, by weight percent, 9 Cr, 10 Co, 2.5 Mo, 10 W, 1.5 Ta, 5.5 Al, 1.5 Ti, 1.5 Hf, balance Ni, wherein said alloy is processed to be essentially free of script carbides, γ/γ' eutectic islands and porosity by heat treating the alloy to permit solutioning of the script carbides and eutectic islands at a temperature approximately 50° F. above the γ' solvus temperature of the alloy, and hot isostatic pressing for about four hours to eliminate porosity, wherein said alloy has improved resistance to fatigue.

4. The alloy as recited in claim 3 wherein the alloy is a directionally solidified, columnar grain alloy.

5. The alloy as recited in claim 3 wherein the alloy is an equiaxed alloy.

6. A hydrogen embrittlement resistant γ' precipitation strengthened equiaxed or directionally solidified, columnar grain nickel base alloy having a microstructure consisting essentially of a plurality of fine, discrete carbide particles, and γ' precipitates in a γ matrix and being essentially free of script carbides, γ/γ' eutectic islands and porosity, said nickel base alloy having a γ' solvus temperature and consisting essentially of, by weight percent, 8.4 Cr, 10 Co, 0.65 Mo, 5.5 Al, 3.1 Ta, 10 W, 1.4 Hf, 1.1 Ti, 0.015 B, 0.05 Zr, balance Ni, wherein said alloy is processed to be essentially free of script carbides, γ/γ' eutectic islands and porosity by heat treating the alloy to permit solutioning of the script carbides and eutectic islands at a temperature approximately 50° F. above the γ' solvus temperature of the alloy, and hot isostatic pressing for about four hours to eliminate porosity, wherein said alloy has improved resistance to fatigue.

* * * * *